US010888154B2

(12) United States Patent
Torres

(10) Patent No.: US 10,888,154 B2
(45) Date of Patent: Jan. 12, 2021

(54) FLUID DISPENSING BRUSH

(71) Applicant: Melinda Torres, Homestead, FL (US)

(72) Inventor: Melinda Torres, Homestead, FL (US)

( * ) Notice: Subject to any disclaimer, the term of this patent is extended or adjusted under 35 U.S.C. 154(b) by 27 days.

(21) Appl. No.: 16/208,733

(22) Filed: Dec. 4, 2018

(65) Prior Publication Data

US 2020/0170398 A1 Jun. 4, 2020

(51) Int. Cl.
*A46B 11/00* (2006.01)

(52) U.S. Cl.
CPC ..... *A46B 11/002* (2013.01); *A46B 11/0006* (2013.01); *A46B 11/001* (2013.01); *A46B 2200/102* (2013.01); *A46B 2200/104* (2013.01)

(58) Field of Classification Search
CPC ..... A46B 11/002; A46B 11/0006; A46B 200/104; A46B 11/00; A46B 2200/10; A46B 2200/102; A46B 11/001; A46B 11/0024; A46B 11/0041; A46B 11/0065; A46B 11/0072
See application file for complete search history.

(56) References Cited

U.S. PATENT DOCUMENTS 2,794,443 A * 6/1957 Moore ..... A45D 24/24 132/113
D289,344 S 4/1987 O'Connor
4,922,859 A * 5/1990 Durell ..... A01K 13/00 119/603
5,927,290 A * 7/1999 Thiruppathi ..... A46B 11/0017 132/116
5,975,089 A 11/1999 Simon
6,022,163 A 2/2000 Asfur
6,065,891 A 5/2000 Rechman
6,170,108 B1 * 1/2001 Knight ..... A46B 13/008 15/29
6,505,983 B1 1/2003 Seo
6,745,779 B2 6/2004 Piatetsky
7,261,108 B2 8/2007 Dallianis
7,427,169 B2 * 9/2008 Ma ..... A45D 19/02 132/113
8,118,036 B2 2/2012 Wang
8,360,668 B1 * 1/2013 Hinnant ..... A46B 5/0075 401/188 R
9,210,982 B2 12/2015 Alsalameh
2008/0149123 A1 6/2008 McKay

* cited by examiner

*Primary Examiner* — David J Walczak

(57) ABSTRACT

A fluid dispensing brush for applying a fluid to hair includes a plurality of bristles that is coupled to and extends from a housing. The bristles are tubular and are in fluidic communication with an interior space defined by the housing. Each of a plurality of holes is positioned in a respective bristle. A handle extends from a first end of the housing. A channel extends through the handle to the housing. A pump is positioned in the channel proximate to the housing and is in fluidic communication with the interior space. A reservoir is selectively insertable into the channel so that a nozzle of the reservoir sealably couples to an inlet of the pump. The pump is configured to selectively pump a fluid that is positioned in the reservoir through the interior space and the bristles to exit through the holes to apply the fluid to the hair.

17 Claims, 3 Drawing Sheets

FLUID DISPENSING BRUSH

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention.

(2) Description of Related Art including information disclosed under 37 CFR 1.97 and 1.98.

The disclosure and prior art relate to brushes and more particularly pertains to a new brush for applying a fluid to hair.

BRIEF SUMMARY OF THE INVENTION

An embodiment of the disclosure meets the needs presented above by generally comprising a plurality of bristles that is coupled to and extends from a housing. The bristles are tubular and are in fluidic communication with an interior space defined by the housing. Each of a plurality of holes is positioned in a respective bristle. A handle extends from a first end of the housing. A channel extends through the handle to the housing. A pump is positioned in the channel proximate to the housing and is in fluidic communication with the interior space. A reservoir is selectively insertable into the channel so that a nozzle of the reservoir sealably couples to an inlet of the pump. The pump is configured to selectively pump a fluid that is positioned in the reservoir through the interior space and the bristles to exit through the holes to apply the fluid to the hair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
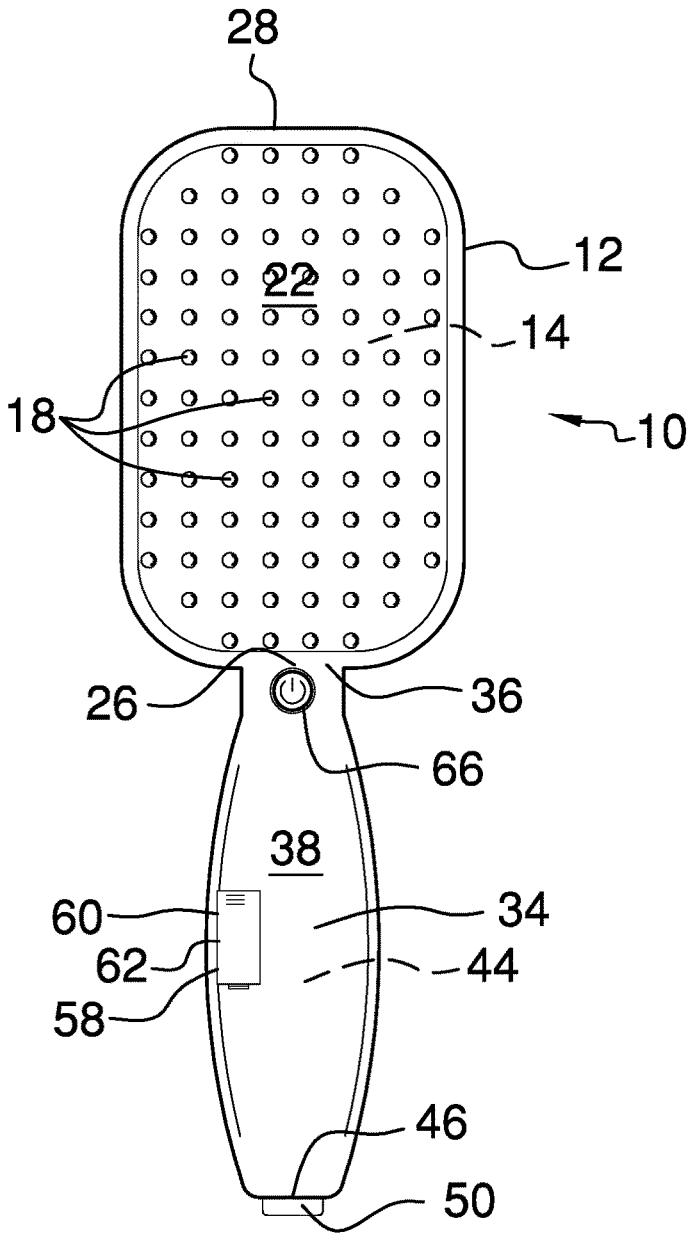
FIG. 1 is a front view of a fluid dispensing brush according to an embodiment of the disclosure.

With reference now to the drawings, and in particular to FIGS. 1 through 5 thereof, a new brush embodying the principles and concepts of an embodiment of the disclosure and generally designated by the reference numeral 10 will be described.

As best illustrated in FIGS. 1 through 5, the fluid dispensing brush 10 generally comprises a housing 12 that defines an interior space 14. The housing 12 is substantially rectangularly box shaped. The housing 12 has corner edges 16 that are arcuate. As will become apparent, the rounded configuration of the corner edges 16 promotes comfort when using the brush 10.

A plurality of bristles 18 is coupled to and extends from a front 22 of the housing 12. The bristles 18 are tubular and are in fluidic communication with the interior space 14. Each bristle 18 has a terminus 20 distal from the front 22 of the housing 12 that is closed. The bristles 18 are positioned in a plurality of rows 24, as shown in FIG. 1. Each row 24 extends from proximate to a first end 26 to proximate to a second end 28 of the housing 12. The plurality of rows 24 comprises eight rows 24.

Figure 2:
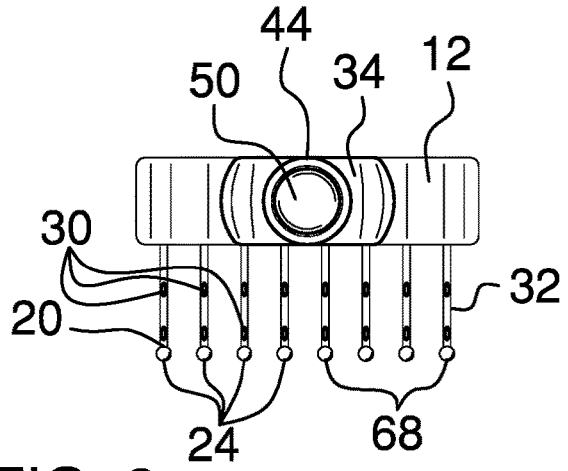
FIG. 2 is an end view of an embodiment of the disclosure.

Each of a plurality of holes 30 is positioned in a respective bristle 18. The holes 30 are positioned two-apiece in the respective bristle 18. The holes 30 are positioned singly proximate to a midpoint 32 and the terminus 20 of the respective bristle 18, as shown in FIG. 2.

Figure 4:
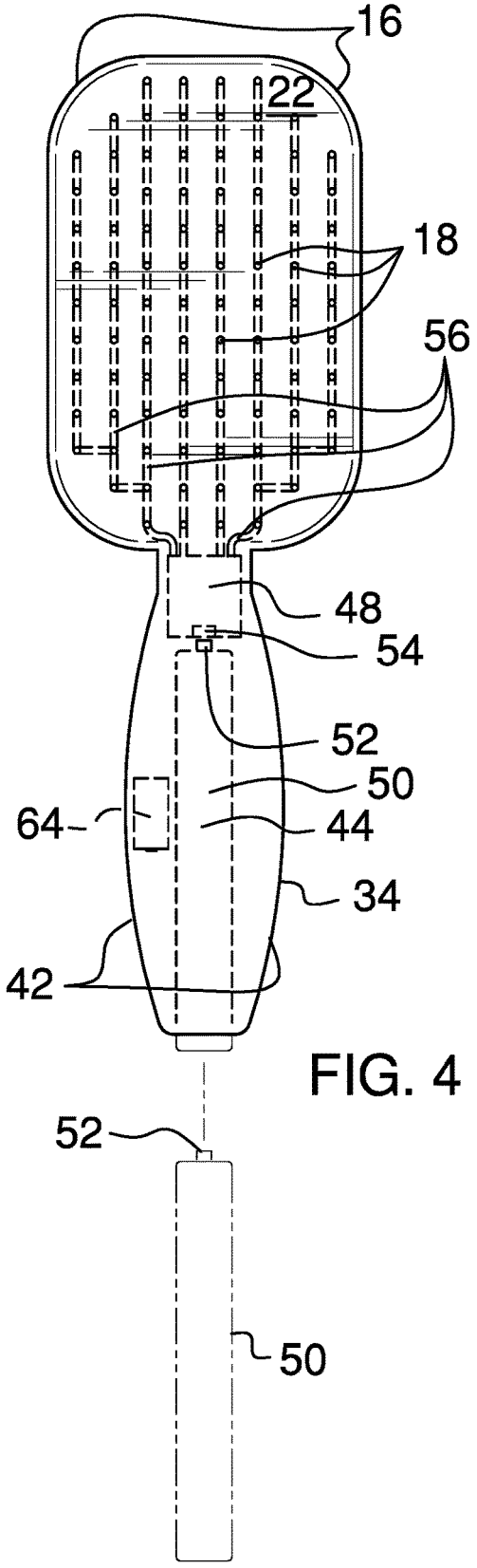
FIG. 4 is a back view of an embodiment of the disclosure.

A handle 34 is coupled by a first endpoint 36 to the first end 26 of the housing 12. The handle 34 is configured to be grasped in a hand of a user, positioning the user to manipulate the bristles 18 through hair. The handle 34 has a forward face 38 and a rearward face 40 that are substantially planar. The handle 34 has opposing side faces 42 that are convexly arcuate, as shown in FIG. 4. The handle 34 comprises at least one of rubber and silicone so that the handle 34 is resiliently compressible and readily grasped in the hand of the user.

A channel 44 extends through the handle 34 from a second endpoint 46 of the handle 34 to the housing 12, as shown in FIG. 4. The channel 44 is substantially circularly shaped when viewed longitudinally. A pump 48 is coupled to the handle 34 and is positioned in the channel 44 proximate to the housing 12. The pump 48 is in fluidic communication with the interior space 14.

A reservoir 50 is selectively insertable into the channel 44 so that a nozzle 52 of the reservoir 50 sealably couples to an inlet 54 of the pump 48. The reservoir 50 is in fluidic communication with the pump 48 so that the pump 48 is configured to selectively pump a fluid that is positioned in the reservoir 50 through the interior space 14 and the bristles 18. The fluid, such as a hair dye or an oil, exits the holes 30 and is applied to the hair without the fluid coming into contact with the hands of the user.

Figure 5:
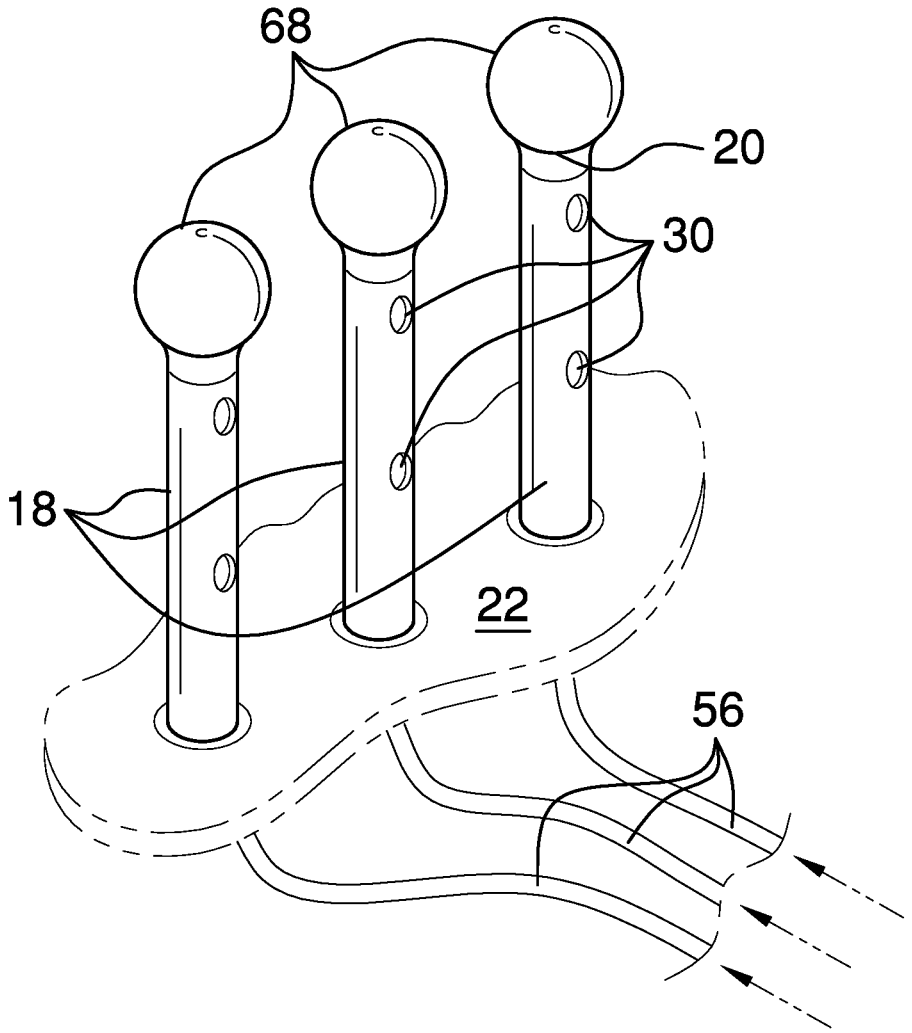
FIG. 5 is a cross-sectional view of an embodiment of the disclosure.

In one embodiment, as shown in FIGS. 4 and 5, a plurality of tubes 56 is coupled to and extends between the pump 48 and the plurality of bristles 18 so that the plurality of bristles 18 is fluidically coupled to the pump 48. The pump 48 is configured to selectively pump the fluid that is positioned in the reservoir 50 through the tubes 56 and the bristles 18 so that the fluid exits the holes 30 and is applied to the hair.

Figure 3:
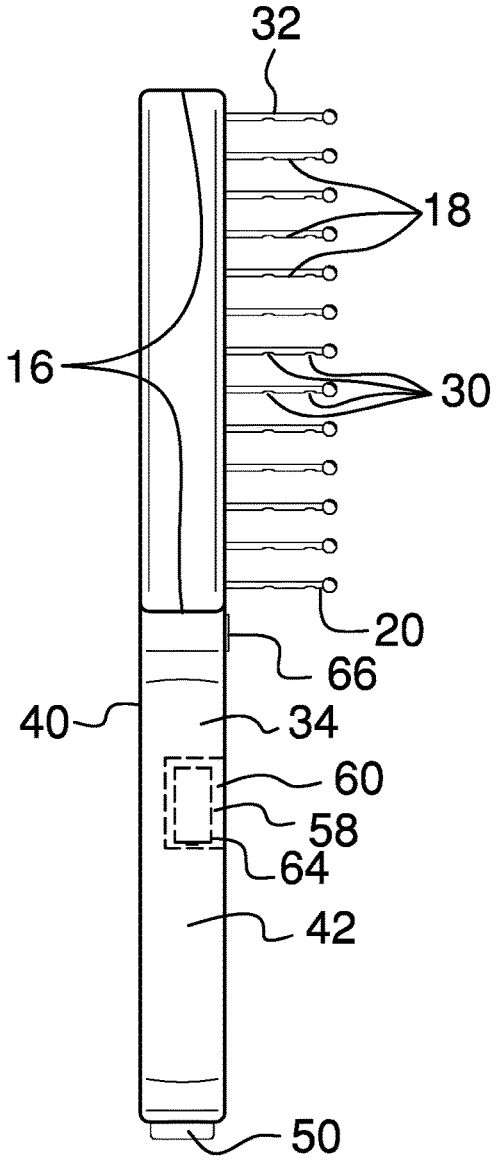
FIG. 3 is a side view of an embodiment of the disclosure.

A recess 58 extends into the handle 34 from a respective opposing side face 42 of the handle 34, as shown in FIG. 3. A panel 60 is selectively couplable to the handle 34 to close the recess 58. A power module 62 is positioned in the recess 58 and is operationally coupled to the pump 48. The power module 62 is positioned to power the pump 48 to selectively pump the fluid that is positioned in the reservoir 50 through the interior space 14 and the bristles 18. The power module 62 comprises a battery 64.

A switch 66 is coupled to the handle 34 and is operationally coupled to both the pump 48 and the power module 62, as shown in FIG. 1. The switch 66 is configured to be selectively switched to couple the pump 48 to the power module 62 so that the pump 48 is positioned to pump the fluid that is positioned in the reservoir 50 through the interior space 14 and the bristles 18. The switch 66 is push-button type and is configured to be depressed a first time to operationally couple the pump 48 to the power module 62. The switch 66 is configured to be depressed a second time to decouple the pump 48 from the power module 62. The switch 66 is positioned on the forward face 38 of the handle 34 proximate to the housing 12 so that the switch is positioned proximate to an index finger and a thumb of the hand of the user.

Each of a plurality of bulbs 68 is coupled to the terminus 20 of a respective bristle 18, as shown in FIG. 3. The bulbs 68 are configured to massage a scalp as the user manipulates the plurality of bristles 18 through the hair. The bulbs 68 comprise at least one of rubber and silicone so that the bulbs 68 are resiliently compressible. The bulbs 68 facilitate insertion of the bristles 18 into the hair and function also to pad the termini 20 of the bristles 18.

In use, the reservoir 50 containing the fluid required by the user is inserted into the channel 44 to couple the nozzle 52 of the reservoir 50 to the inlet 54 of the pump 48. The switch 66 is used to actuate the pump 48 to pump the fluid through the tubes 56 and the bristles 18 so that the fluid exits the holes 30 and is applied to the hair.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A fluid dispensing brush comprising:

a housing defining an interior space;

a plurality of bristles coupled to and extending from a front of the housing, the bristles being tubular such that the bristles are in fluidic communication with the interior space, each bristle having a terminus distal from the front of the housing, the terminus being closed;

a handle coupled by a first endpoint to a first end of the housing wherein the handle is configured for grasping in a hand of a user positioning the user for manipulating the bristles through hair;

a plurality of holes, each hole being positioned in a respective bristle, each hole being positioned on a side of said respective bristle facing said handle wherein an opposite side of said respective bristle facing away from said handle is solid;

a channel extending through the handle from a second endpoint of the handle to the housing;

a pump coupled to the handle and positioned in the channel proximate to the housing such that the pump is in fluidic communication with the interior space;

a reservoir selectively insertable into the channel such that a nozzle of the reservoir sealably couples to an inlet of the pump such that the reservoir is in fluidic communication with the pump wherein the pump is configured for selectively pumping a fluid positioned in the reservoir through the interior space and the bristles such that the fluid exits the holes for applying the fluid to the hair; and a plurality of bulbs, each bulb being coupled to the terminus of a respective bristle wherein the bulbs are configured for massaging a scalp as the user manipulates the plurality of bristles through the hair, the bulbs comprising at least one of rubber and silicone such that the bulbs are resiliently compressible.

2. The brush of claim 1, further including the housing being substantially rectangularly box shaped.

3. The brush of claim 2, further including the housing having corner edges, the corner edges being arcuate.

4. The brush of claim 1, further including the bristles being positioned in a plurality of rows, each row extending from proximate to the first end to proximate to a second end of the housing.

5. The brush of claim 4, further including the plurality of rows comprising eight rows.

6. The brush of claim 1, further including the holes being positioned two-apiece in the respective bristle.

7. The brush of claim 6, further including the holes being positioned singly proximate to a midpoint and a terminus of the respective bristle.

8. The brush of claim 1, further including the handle having a forward face and a rearward face, the forward face and the rearward face being substantially planar, the handle having opposing side faces, the opposing side faces being convexly arcuate.

9. The brush of claim 1, further including the handle comprising at least one of rubber and silicone such that the handle is resiliently compressible.

10. The brush of claim 1, further including the channel being substantially circularly shaped when viewed longitudinally.

11. The brush of claim 1, further including a plurality of tubes coupled to and extending between the pump and the plurality of bristles such that the plurality of bristles is fluidically coupled to the pump.

12. The brush of claim 1, further comprising:

a recess extending into the handle from a respective opposing side face of the handle;

a panel selectively couplable to the handle for closing the recess; and a power module positioned in the recess, the power module being operationally coupled to the pump wherein the power module is positioned for powering the pump for selectively pumping the fluid positioned in the reservoir through the interior space and the bristles such that the fluid exits the holes for applying the fluid to the hair.

13. The brush of claim 12, further including the power module comprising a battery.

14. The brush of claim 12, further including a switch coupled to the handle, the switch being operationally coupled to the pump and the power module wherein the switch is configured for being selectively switched for coupling the pump to the power module such that the pump is positioned for pumping the fluid positioned in the reservoir through the interior space and the bristles such that the fluid exits the holes for applying the fluid to the hair.

15. The brush of claim 14, further including the switch being push-button type wherein the switch is configured for depressing a first time for operationally coupling the pump to the power module and for depressing a second time for decoupling the pump from the power module.

16. The brush of claim 14, further including the switch being positioned on a forward face of the handle proximate to the housing.

17. A fluid dispensing brush comprising:

a housing defining an interior space, the housing being substantially rectangularly box shaped, the housing having corner edges, the corner edges being arcuate;

a plurality of bristles coupled to and extending from a front of the housing, the bristles being tubular such that the bristles are in fluidic communication with the interior space, each bristle having a terminus distal from the front of the housing, the terminus being closed, the bristles being positioned in a plurality of rows, each row extending from proximate to a first end to proximate to a second end of the housing, the plurality of rows comprising eight rows;

a handle coupled by a first endpoint to the first end of the housing wherein the handle is configured for grasping in a hand of a user positioning the user for manipulating the bristles through hair, the handle having a forward face and a rearward face, the forward face and the rearward face being substantially planar, the handle having opposing side faces, the opposing side faces being convexly arcuate, the handle comprising at least one of rubber and silicone such that the handle is resiliently compressible;

a plurality of holes, each hole being positioned in a respective bristle, each hole being positioned on a side of said respective bristle facing said handle wherein an opposite side of said respective bristle facing away from said handle is solid, the holes being positioned two-apiece in the respective bristle, the holes being positioned singly proximate to a midpoint and the terminus of the respective bristle;

a channel extending through the handle from a second endpoint of the handle to the housing, the channel being substantially circularly shaped when viewed longitudinally;

a pump coupled to the handle and positioned in the channel proximate to the housing such that the pump is in fluidic communication with the interior space;

a reservoir selectively insertable into the channel such that a nozzle of the reservoir sealably couples to an inlet of the pump such that the reservoir is in fluidic communication with the pump wherein the pump is configured for selectively pumping a fluid positioned in the reservoir through the interior space and the bristles such that the fluid exits the holes for applying the fluid to the hair;

a plurality of tubes coupled to and extending between the pump and the plurality of bristles such that the plurality of bristles is fluidically coupled to the pump;

a recess extending into the handle from one of said opposing side faces of the handle;

a panel selectively couplable to the handle for closing the recess;

a power module positioned in the recess, the power module being operationally coupled to the pump wherein the power module is positioned for powering the pump for selectively pumping the fluid positioned in the reservoir through the interior space and the bristles such that the fluid exits the holes for applying the fluid to the hair, the power module comprising a battery;

a switch coupled to the handle, the switch being operationally coupled to the pump and the power module wherein the switch is configured for being selectively switched for coupling the pump to the power module such that the pump is positioned for pumping the fluid positioned in the reservoir through the interior space and the bristles such that the fluid exits the holes for applying the fluid to the hair, the switch being push-button type wherein the switch is configured for depressing a first time for operationally coupling the pump to the power module and for depressing a second time for decoupling the pump from the power module, the switch being positioned on the forward face of the handle proximate to the housing; and a plurality of bulbs, each bulb being coupled to the terminus of a respective bristle wherein the bulbs are configured for massaging a scalp as the user manipulates the plurality of bristles through the hair, the bulbs comprising at least one of rubber and silicone such that the bulbs are resiliently compressible.

* * * * *